US008464729B2

(12) United States Patent
Liao et al.

(10) Patent No.: US 8,464,729 B2
(45) Date of Patent: Jun. 18, 2013

(54) HAIR STYLER CAPABLE OF PRODUCING STEAM

(75) Inventors: Feng-Chih Liao, Taichung (TW); Yen-Chin Cheng, Taichung (TW)

(73) Assignee: Manica-Taiwan Incorporated, Taichung (TW)

( * ) Notice: Subject to any disclaimer, the term of this patent is extended or adjusted under 35 U.S.C. 154(b) by 138 days.

(21) Appl. No.: 13/188,304

(22) Filed: Jul. 21, 2011

(65) Prior Publication Data

US 2013/0019890 A1 Jan. 24, 2013

(51) Int. Cl.
*A45D 6/06* (2006.01)

(52) U.S. Cl.
USPC ..... 132/228; 132/332; 132/272; 219/225; 219/227; 392/395; 392/404

(58) Field of Classification Search
USPC .. 132/118, 226–232, 269, 271, 272; 219/222, 219/225–230; 392/395, 399, 403, 404; 122/DIG. 10, 366, 4 R, 40
See application file for complete search history.

(56) References Cited

U.S. PATENT DOCUMENTS

| | | | | | |
|---|---|---|---|---|---|
| 3,934,597 | A * | 1/1976 | McNair | 132/232 |
| 3,937,232 | A * | 2/1976 | Tomaro | 132/232 |
| 4,009,367 | A * | 2/1977 | Rizzuto | 219/222 |
| 4,029,110 | A * | 6/1977 | Hyland | 132/232 |
| 4,034,201 | A * | 7/1977 | Walter et al. | 219/222 |
| 4,192,328 | A * | 3/1980 | Barradas et al. | 132/232 |
| 4,209,685 | A * | 6/1980 | Walter et al. | 219/225 |
| 4,326,545 | A * | 4/1982 | Motegi et al. | 132/229 |
| 4,419,565 | A * | 12/1983 | McGaw | 219/222 |
| 4,469,934 | A * | 9/1984 | Isshiki et al. | 219/222 |
| 4,771,797 | A * | 9/1988 | Kosaka | 132/272 |
| 5,223,694 | A * | 6/1993 | Tsuji et al. | 219/225 |
| 6,701,937 | B2 * | 3/2004 | Janouch et al. | 132/228 |
| 6,802,320 | B2 * | 10/2004 | Janouch et al. | 132/227 |
| 2002/0056466 | A1 * | 5/2002 | Omura | 132/272 |

* cited by examiner

*Primary Examiner* — Robyn Doan
*Assistant Examiner* — Tatiana Nobrega
(74) *Attorney, Agent, or Firm* — Shimokaji & Associates P.C.

(57) ABSTRACT

A hair styler capable of producing steam not only can produce steam to assistant the user doing hair style, but also that the hair styler is provided with leak proof members between the respective parts of the hair styler, which can provide better sealing effect and prevent water leakage problems.

9 Claims, 6 Drawing Sheets

HAIR STYLER CAPABLE OF PRODUCING STEAM

BACKGROUND OF THE INVENTION

1. Field of the Invention

The present invention relates to a hair styler, and more particularly to a hair styler capable of producing steam.

2. Description of the Prior Art

Conventional handheld hair stylers are generally provided with an electric heating device and held by hand to do hairstyle. Some of the hair stylers are provided at one end thereof with a steam producing device which comprises at water container and a heat receiver abutted against each other. The heat receiver is connected to and heated by the heating device inside the hair styler. Pressing the water container would make the water container disengage from the heat receiver, and then the water flows from the water container to the heat receiver and heated into steam by the heat receiver. However, the sealing of the respective parts of the steam producing device of the conventional hair stylers is too bad, and always causes water leakage.

The present invention has arisen to mitigate and/or obviate the afore-described disadvantages.

SUMMARY OF THE INVENTION

The primary object of the present invention is to provide a hair styler capable of producing steam which is free of leakage problem.

To achieve the above object, a hair styler capable of producing steam in accordance with the present invention comprises: a housing, an elastic assembly, a hot core assembly, a pressing seat, a third leak proof member, and a water continuer.

The housing has an open end, inside the housing is disposed a heater, and in an outer surface of the housing are provided a plurality of apertures.

The elastic assembly is disposed adjacent to the heater, and the heater extends into a central hole of the pressing member.

The hot core assembly is pressed against the elastic assembly and comprises a water absorbing cover covering a water absorbing member, the water absorbing member is formed at one end thereof with at least one outward protruding water absorbing portion which will extend out of at least one gap formed at an periphery of a first shoulder of the water absorbing cover, and a first leak proof member is abutted against the first shoulder of the water absorbing cover, a second elastic member and a second leak proof member are sleeved on the water absorbing cover, and then the water absorbing cover is inserted in a hot core cover in such a manner that the second leak proof member of the hot core assembly is pressed against the inner periphery of the hot core cover, the second elastic member has one end pressed against the water absorbing cover and another end pressed against the second leak proof member, a sealing cover being fixed to one end of the water absorbing cover by the fastener to press against the first leak proof member and the hot core cover, under sealed conditions, the second elastic member pushes the hot core cover against the sealing cover to make the hot core cover sealed by the sealing cover.

The pressing seat includes a central hole and inserted in the open end of the housing and pressed against an outer periphery of the hot core cover, and the third leak proof member is located between the pressing seat and the hot core cover.

The water container is connected to the pressing seat to seal the central hole of the pressing seat.

DETAILED DESCRIPTION OF THE PREFERRED EMBODIMENTS

Figure 1:
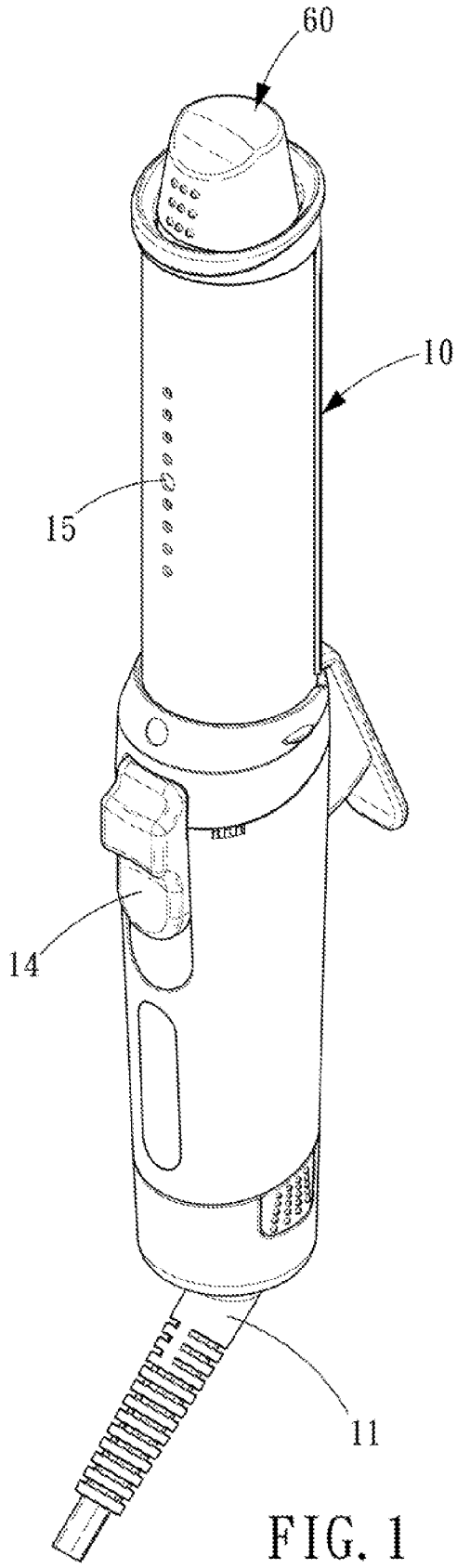
FIG. 1 is a perspective view of a hair styler capable of producing steam in accordance with the present invention.
Figure 2:
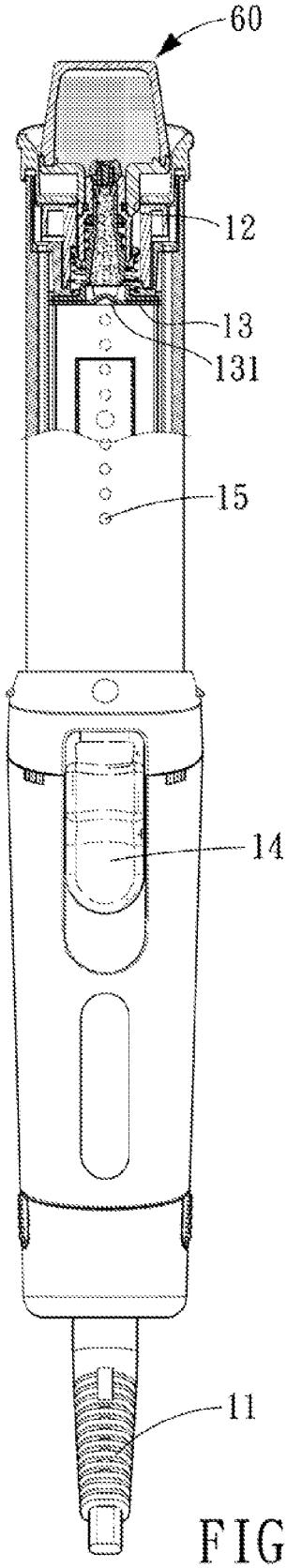
FIG. 2 is a partially cross sectional view showing the hair styler capable of producing steam in accordance with the present invention.
Figure 3:
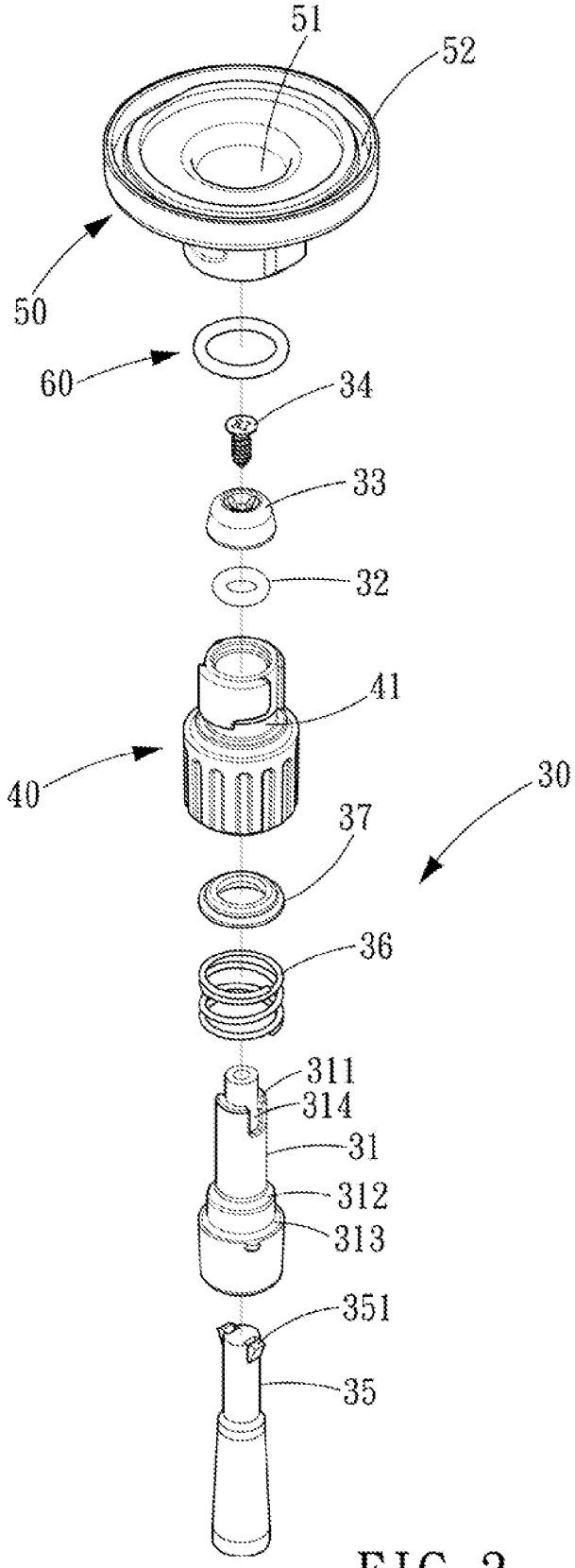
FIG. 3 is an exploded view of a part of the hair styler capable of producing steam in accordance with the present invention.

The present invention will be clearer from the following description when viewed together with the accompanying drawings, which show, for purpose of illustrations only, the preferred embodiment in accordance with the present invention.

Referring to FIGS. 1-6, a hair styler capable of producing steam in accordance with the present invention is shown and comprises: a housing 10, an elastic assembly 20, a hot core assembly 30, a hot core cover 40, a pressing seat 50, a third leak proof member 60 and a water container 70.

The housing 10 has an open end 12 and is provided at another end thereof with a power supplier 11. Inside the housing 10 is disposed a heater 13 which has a heating end 131 protruding towards the open end 12 and is electrically connected to and controlled by a power-supply switch 14 disposed on the outer surface of the housing 10. The power supplier 11 is electrically connected to the heater 13. The housing 10 is provided with a plurality of apertures 15 in the outer surface there of adjacent to the open end 12.

The elastic assembly 20 is adjacent to the heater 13 and comprises a pressing member 21, a first elastic pressing member 22, a first elastic member 23 and a second elastic pressing member 24. The pressing member 21 is pressed against the heater 13 in such a manner that the heating end 131 of the heater 13 extends into a central hole 211 of the pressing member 21. The first elastic pressing member 22 is sleeved on the pressing member 21 and has a central hole 221 in communication with the central hole 211 of the pressing member 21. The first elastic member 23 has one end sleeved on the first elastic pressing member 22, and the second elastic pressing member 24 has one end inserted in and pressed against another end of the first elastic member 23 and has a central hole 241 in communication with the central holes 221, 211 of the first elastic pressing member 22 and the pressing member 21.

The hot core assembly 30 comprises a water absorbing cover 31, a first leak proof member 32, a sealing cover 33, a fastener 34, a water absorbing member 35, a second elastic member 36 and a second leak proof member 37.

The water absorbing cover 31 is a hollow pipe and has three different diameter shoulders, namely, a first shoulder 311, a second shoulder 312 and a third shoulder 313, wherein the second shoulder 312 has an outer diameter larger than the first shoulder 311 but less than the third shoulder 313. In a periphery of the first shoulder 311 of the water absorbing cover 31 are formed two opposite gaps 314, and the first leak proof member 32 is abutted against the first shoulder 311.

The water absorbing member 35 is made of water absorbing material and formed corresponding to the inner shape of the water absorbing cover 31. At one end of the water absorbing member 35 are formed two opposite outward protruding water absorbing portions 351 which will extend out of the gaps 314 of the water absorbing cover 31 when the water absorbing member 35 is inserted in the water absorbing cover 31.

The second elastic member 36 is sleeved on the water absorbing cover 31 and has one end pressed against the third shoulder 31.3 of the water absorbing cover 31 and another end pressed against the second leak proof member 37 which is movably disposed between the first and second shoulders 311, 312 of the water absorbing cover 31.

Figure 4:
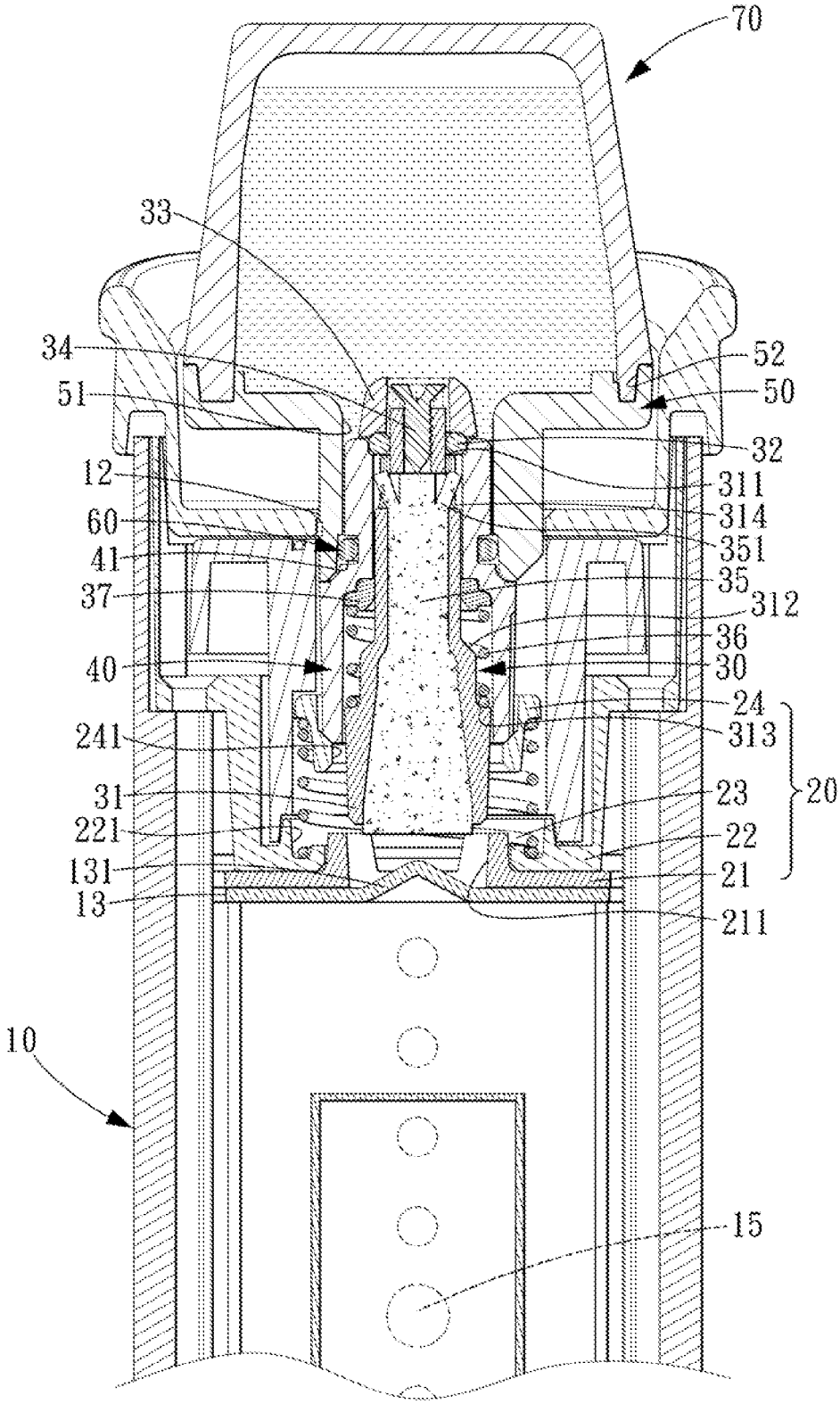
FIG. 4 is an amplified cross sectional view of a part of the hair styler capable of producing steam in accordance with the present invention.

The hot core cover 40 is mounted on the hot core assembly 30 and abutted against the second elastic pressing member 24 in such a manner that the second leak proof member 37 of the hot core assembly 30 is pressed against the inner periphery of the hot core cover 40, and the water absorbing cover 31 and the water absorbing member 35 extend through the central hole 241 of the second elastic pressing member 24 and the first elastic member 23 toward the heater 13, so that the hot core cover 40 can drive the hot core assembly 30 and the elastic assembly 20 to move toward the heater 13. The hot core cover 40 is formed around its outer surface with an annular groove 41. After the hot core cover 40 is mounted on the hot core assembly 30, the sealing cover 33 is fixed to the end of the water absorbing cover 31 adjacent to the first leak proof member 32 by the fastener 34 to press against and position the first leak proof member 32. Under sealed conditions, the second elastic member 36 pushes the hot core cover 40 against the sealing cover 33, in other words, the hot core cover 40 is sealed by the sealing cover 33, as shown in FIG. 4.

The pressing seat 50 includes a central hole 51 and an annular groove 52 at an end surface thereof. The pressing seat 50 is inserted in the open end 12 of the housing 10 and mounted on the hot core cover 40 and pressed against the outer periphery of the hot core cover 40 in such a manner that the hot core cover 40 is inserted in the central hole 51 of the pressing seat 50 and the sealing cover 33 of the hot core assembly 30 extends out of the central hole 51.

The third leak proof member 60 is received in the annular groove 41 of the hot core cover 40 and located between the pressing seat 50 and the hot core cover 40.

The water container 70 is connected to the pressing seat 50 to seal the central hole 51 of the pressing seat 50 in such a manner that the periphery edge of the water container 70 is inserted in the annular groove 52 of the pressing seat 50.

Figure 5:
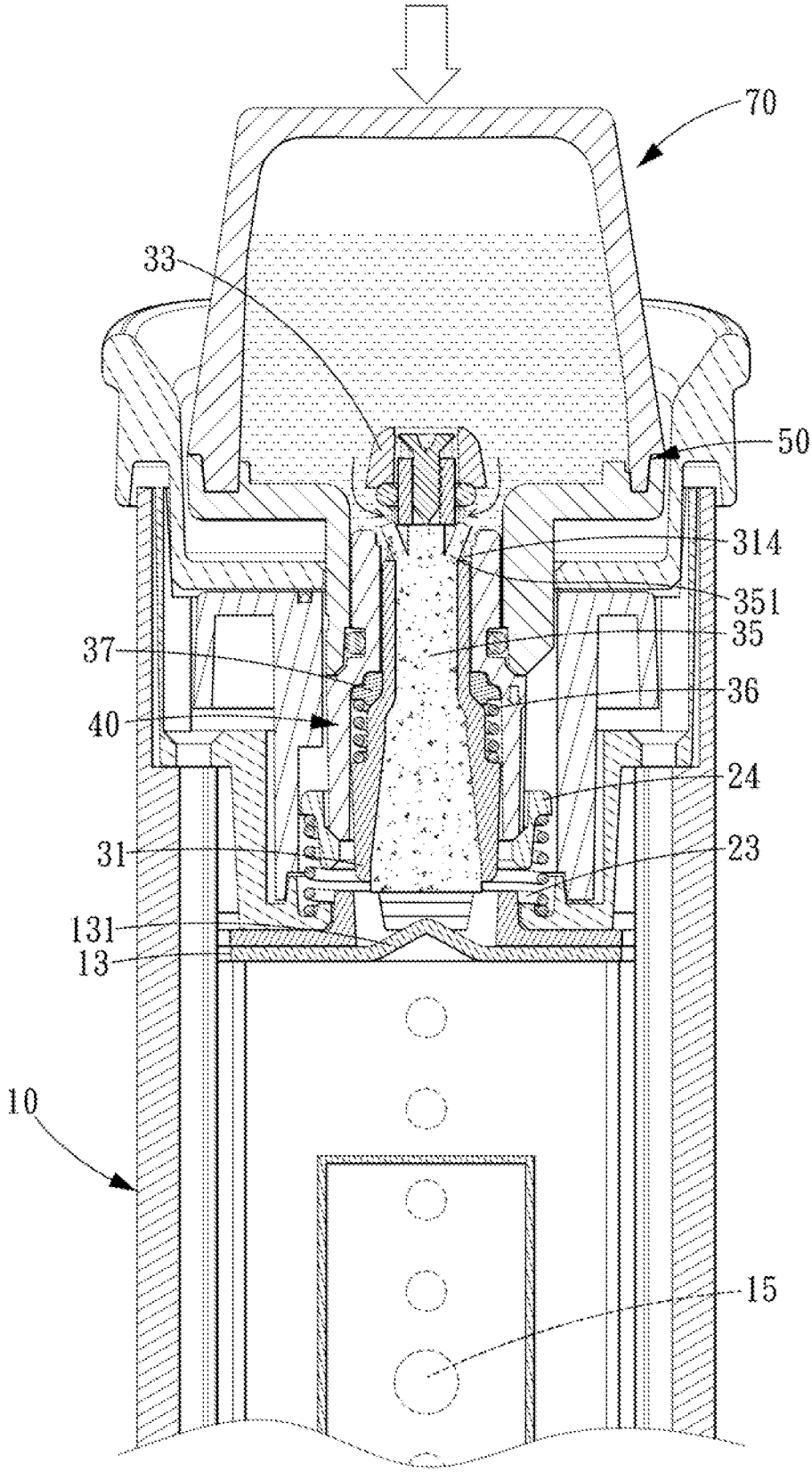
FIG. 5 is a first operational view in accordance with the present invention showing that the water container is being pressed.
Figure 6:
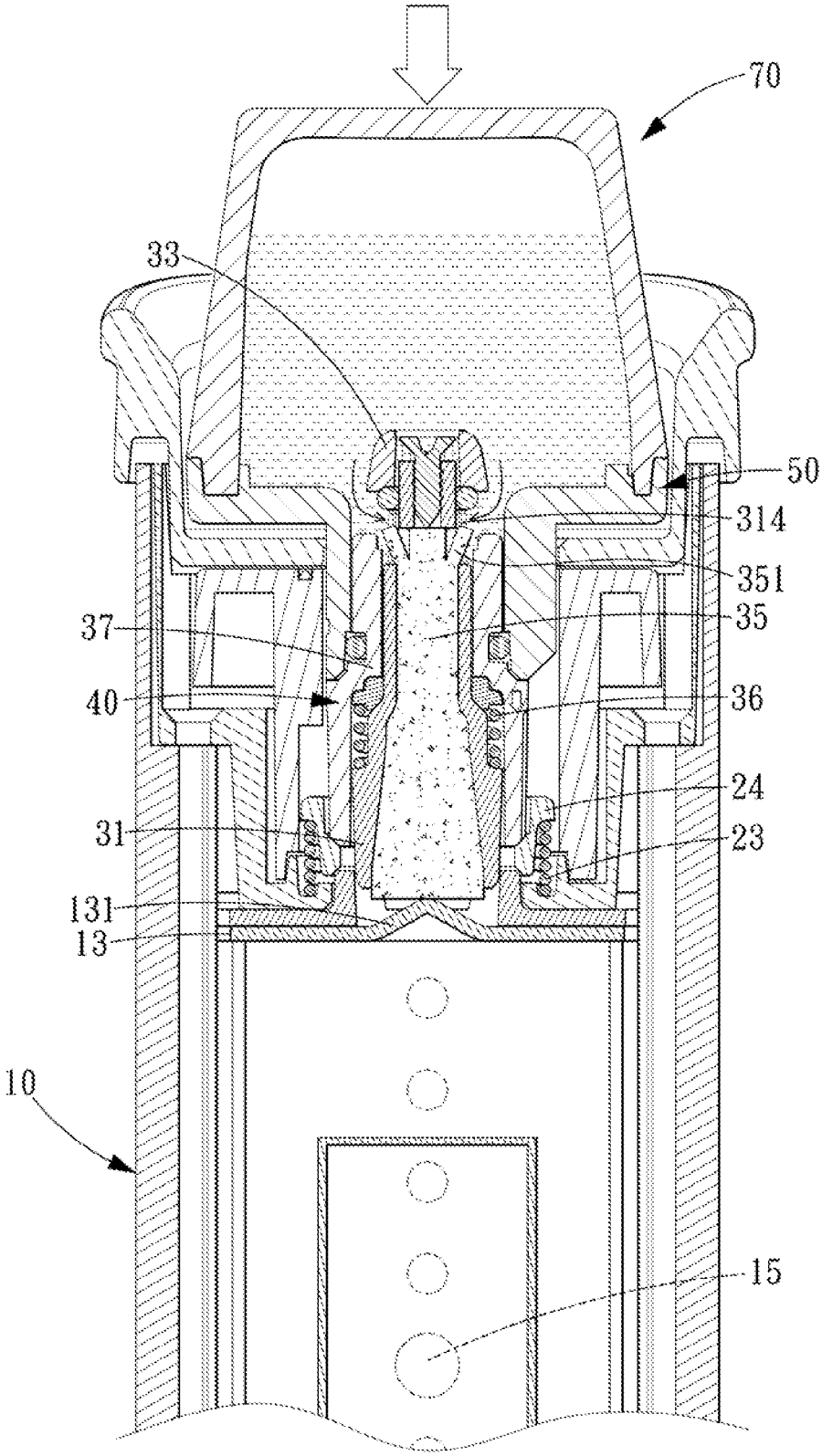
FIG. 6 is a second operational view in accordance with the present invention showing that the water container is being pressed.

The structural relationships of the respective parts of the hair styler capable of producing steam in accordance with the present invention are as mentioned above. In use of the hair styler, the power-supply switch 14 of the housing 10 turns on the heater 13, and then the user presses the water container 70. The pressing force is transmitted to the hot core cover 40 through the pressing seat 50, so that the hot core cover 40 presses the second leak proof member 37 and then the second elastic pressing member 24 via the second elastic member 36. Consequently, the second elastic pressing member 24 presses the first elastic member 23 by moving toward the heater 13, as shown in FIGS. 5 and 6, and in this way, the hot core cover 40 pushes the hot core assembly 30 toward the heater 13. Meanwhile, the movement of the hot core cover 40 toward the heater 13 make the hot core cover 40 disengage from the sealing cover 33 of the hot core assembly 30, so that water will flow out of the water container 70 into the water absorbing cover 31 and will be absorbed by the water absorbing portion 351 of the water absorbing member 35 via the clearance between the hot core cover 40 and the sealing cover 33 and the gaps 314 of the water absorbing cover 31. When the user continue pressing the water container 70 to make the water absorbing member 35 contact the heating end 131 of the heater 13, the water absorbed in the water absorbing member 35 will be heated into steam, and the steam will come out of the apertures 15 of the housing 10, so that the user can use it to do hairstyle.

When finished using the hairstyler, the user only needs to stop pressing the water container 70, the first and second elastic members 23, 36 will push respective parts back to their positions, the hot core cover 40 move back to the sealing cover 33, so that the first leak proof member 32 therebetween, the second leak proof member 37 between the water absorbing cover 31 and the hot core cover 40, and the third leak proof member 60 between the hot core cover 40 and the pressing seat 50 will provide better sealing performance when the hairstyler is not being used.

While we have shown and described various embodiments in accordance with the present invention, it is clear to those skilled in the art that further embodiments may be made without departing from the scope of the present invention.

What is claimed is:

1. A hair styler capable of producing steam, comprising:

a housing with an open end, inside the housing being disposed a heater, and in an outer surface of the housing being provided a plurality of apertures;

an elastic assembly disposed adjacent to the heater, and the heater extending into a central hole of a pressing member;

a hot core assembly pressed against the elastic assembly and comprising a water absorbing cover covering a water absorbing member, the water absorbing member being formed at one end thereof with at least one outward protruding water absorbing portion which will extend out of at least one gap formed at an periphery of a first shoulder of the water absorbing cover, and a first leak proof member being abutted against the first shoulder of the water absorbing cover, a second elastic member and a second leak proof member being sleeved on the water absorbing cover, and then the water absorbing cover being inserted in a hot core cover in such a manner that the second leak proof member of the hot core assembly is pressed against the inner periphery of the hot core cover, the second elastic member has one end pressed against the water absorbing cover and another end pressed against the second leak proof member, a sealing cover being fixed to one end of the water absorbing cover by a fastener to press against the first leak proof member and the hot core cover, under sealed conditions, the second elastic member pushes the hot core cover against the sealing cover to make the hot core cover sealed by the sealing cover;

a pressing seat including a central hole and inserted in the open end of the housing and pressed against an outer periphery of the hot core cover, and a third leak proof member being located between the pressing seat and the hot core cover; and a water container connected to the pressing seat to seal the central hole of the pressing seat.

2. The hair styler capable of producing steam as claimed in claim 1, wherein the housing is provided at another end thereof with a power supplier which is electrically connected to and controlled by a power-supply switch disposed on the outer surface of the housing, the heater is electrically connected to the power supplier and has a heating end protruding towards the open end.

3. The hair styler capable of producing steam as claimed in claim 1, wherein the elastic assembly comprises a pressing member, a first elastic pressing member, a first elastic member and a second elastic pressing member, the pressing member is pressed against the heater in such a manner that the heating end of the heater extends into a central hole of the pressing member, the first elastic pressing member is sleeved on the pressing member and has a central hole in communication with the central hole of the pressing member, the first elastic member has one end sleeved on the first elastic pressing member, and the second elastic pressing member has one end inserted in and pressed against another end of the first elastic member and has a central hole in communication with the central holes of the first elastic pressing member and the pressing member.

4. The hair styler capable of producing steam as claimed in claim 1, wherein the water absorbing cover is a hollow pipe and has three different diameter shoulders, namely, the first shoulder, a second shoulder and a third shoulder, wherein the second shoulder has an outer diameter larger than the first shoulder but less than the third shoulder, in a periphery of the first shoulder of the water absorbing cover are formed two opposite gaps, and the first leak proof member is abutted against the first shoulder.

5. The hair styler capable of producing steam as claimed in claim 4, wherein the water absorbing member is made of water absorbing material and formed corresponding to the inner shape of the water absorbing cover, the water absorbing member is formed with two opposite outward protruding water absorbing portions which will extend out of two opposite gaps of the water absorbing cover.

6. The hair styler capable of producing steam as claimed in claim 4, wherein the second elastic member is sleeved on the water absorbing cover and has one end pressed against the third shoulder of the water absorbing cover and another end pressed against the second leak proof member which is movably disposed between the first and second shoulders of the water absorbing cover.

7. The hair styler capable of producing steam as claimed in claim 3, wherein the hot core assembly is received in the hot core cover, and then the hot core cover is abutted against the second elastic pressing member in such a manner that the water absorbing cover and the water absorbing member extend through the central hole of the second elastic pressing member and the first elastic member toward the heater, so that the hot core cover can drive the hot core assembly and the elastic pressing assembly to move toward the heater.

8. The hair styler capable of producing steam as claimed in claim 1, wherein the hot core cover is formed around its outer surface with an annular groove in which the third leak proof member is to be received.

9. The hair styler capable of producing steam as claimed in claim 1, wherein the pressing seat includes an annular groove at an end surface thereof, and the water container is inserted in the annular groove of the pressing seat.

* * * * *